US005322386A

United States Patent [19]

Trangsrud

[11] Patent Number: 5,322,386

[45] Date of Patent: Jun. 21, 1994

[54] GROUND ANCHOR DEVICE

[75] Inventor: Julian P. Trangsrud, Northfield, Minn.

[73] Assignee: Royal Concrete Products, Inc., Ramsey, Minn.

[21] Appl. No.: 134,582

[22] Filed: Oct. 12, 1993

[51] Int. Cl.[5] ..... E02B 3/06; E02D 5/80

[52] U.S. Cl. ..... 405/19; 52/155; 52/162; 405/244

[58] Field of Search ..... 405/244, 259.1, 262, 405/16, 19, 20; 52/155, 164, 162, 156, 157, 166; 248/533, 530, 545

[56] References Cited

U.S. PATENT DOCUMENTS

| | | | |
|---|---|---|---|
| 722,778 | 3/1903 | Wantling | 52/155 |
| 1,564,069 | 12/1955 | Hoovens . | |
| 2,712,864 | 7/1955 | Clevett, Jr. . | |
| 2,892,518 | 6/1959 | Fiske . | |
| 3,468,085 | 9/1969 | Jones | 52/155 |
| 3,498,588 | 3/1970 | Turney | 52/155 X |
| 3,653,167 | 4/1972 | Menard | 52/166 X |
| 3,880,057 | 6/1975 | Zubke . | |
| 4,096,673 | 6/1978 | Deike . | |
| 4,574,539 | 3/1986 | Deike . | |
| 4,644,712 | 2/1987 | Watson | 52/152 |
| 4,688,360 | 8/1987 | Luong et al. . | |
| 4,727,693 | 3/1988 | Rockenfeller et al. . | |
| 4,993,870 | 2/1991 | Bridgewater . | |
| 5,050,355 | 9/1991 | Pildysh . | |
| 5,123,779 | 6/1992 | Miller | 405/244 X |
| 5,175,966 | 1/1993 | Remke et al. . | |

FOREIGN PATENT DOCUMENTS

| | | | |
|---|---|---|---|
| 2055268 | 6/1971 | Fed. Rep. of Germany | 52/162 |
| 4822 | of 1914 | United Kingdom | 52/155 |

*Primary Examiner*—Dennis L. Taylor
*Attorney, Agent, or Firm*—Haugen and Nikolai

[57] ABSTRACT

A ground anchor for use in securing above ground objects in place consists of a molded plastic body member having a cylindrical central portion with a cone-shaped projection terminating in a point at one end thereof and a concentrically disposed cylindrical stem projecting from the other end. The stem is of a smaller O.D. than that of the central portion and, thus, an annular shoulder surface is created at the junction. A tie plate is fitted into a slot formed in the molded plastic body. A cable or other tie member connects to that plate and to the object to be anchored. The anchor is driven into the ground by positioning a drive rod over the stem portion of the anchor body so that the end of that rod abuts the annular shoulder. Then, by hammering on the upper end of the drive rod, the anchor is driven into the ground to the desired depth. The anchor is configured so that tension on the tie cable tends to rotate the anchor within the earth to increase the resistance against pull-out.

11 Claims, 1 Drawing Sheet

GROUND ANCHOR DEVICE

BACKGROUND OF THE INVENTION

I. Field of the Invention

This invention relates generally to ground anchors adapted for use in securing an above ground load to the ground, and more particularly to a low-cost highly effective ground anchor especially adapted for securing concrete erosion control mats in place in drainage ditches, creek bottoms and the like.

II. Discussion of the Prior Art

In the Crow et al. Patent there is described a mat comprising a plurality of concrete blocks which are arranged in a matrix and strung together by means of rods, chains or cables extending through the blocks. The mats are used for reducing erosion caused by running water streams, such as may be present in drainage ditches, culverts, irrigation channels, stream beds and the like. Because of the manner in which the concrete blocks are linked together, the mats are sufficiently flexible so as to generally conform to the ground on which they are laid. The mats are laid in manageable sized sections and must be held together and maintained in position when exposed to the substantial forces of rushing water.

In the past, it has been the practice to insert ground anchors at strategic points relative to the concrete mats and use cable or chain to join the ground anchors to the mats to prevent their migration. A particular ground anchor sold by International Erosion Control, Inc. is quite effective but has the drawback of being unduly expensive. That device is referred to as "duckbill anchor" and comprises a cast metal tubular body having one open end and one closed end. The open end has a beveled arcuate flair formed thereon. This anchor has an eyelet formed on a side wall thereof through which the cable or chain may loop. It is driven into the ground by inserting a pipe or solid rod into the open tubular end of the anchor and then, using a maul or other type of manual or automatic hammer, is driven deep into the ground. When the pipe or rod is removed from the insertion hole made and tension is applied to the cable linked to the anchor, the anchor tends to rotate because of the engagement of the flared duck-bill end with the ground, thus placing the anchor cross-wise relative to the hole through which it had been inserted into the ground. The more tension that is applied to the cable or chain, the more the anchor member rotates, thereby substantially increasing the force that would be required to pull it free of the earth.

SUMMARY OF THE INVENTION

The present invention relates to a low-cost ground anchor which does not sacrifice performance for cost. In its simplest form, the anchoring device of the present invention comprises a molded plastic body having a central cylindrical body portion with first and second opposed ends, one end terminating in a cone leading to a point and the other end having a longitudinally extending, concentrically disposed cylindrical stem of a lesser diameter than that of the central cylindrical body portion. The intersection of the stem with the cylindrical body portion defines an annular shoulder. The molded body member 12 is preferably formed from a suitable plastic, such as a glass-filled polyethylene. However, other plastics may also be suitable. A longitudinal, diametrically located slot is formed in the central body portion. Fitted into this slot is a cable tie plate. It is generally trapezoidal in shape so as to include a somewhat triangular portion that extends outward radially from the slot beyond the periphery of the molded plastic body. An aperture is formed through the triangular portion that extends radially outward from the molded body near its apex, thereby providing a tie point adapted to receive a solid rod, cable, chain or rope therethrough.

To install the anchor, the cable, chain or rope is first looped through the tie point and then the cylindrical stem portion is inserted into a tubular socket formed in the lower end of a rigid drive rod. The exposed end of the rigid rod thus rests against the annular shoulder on the anchor body and provides a surface against which the driving force may be applied. The pointed end of the ground anchor is placed against the ground and the anchor is pounded into the ground by hammering the other end of the rigid drive rod. The depth to which the ground anchor must be driven is, of course, a function of the load to be constrained and the soil conditions of the ground into which the anchor is driven.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
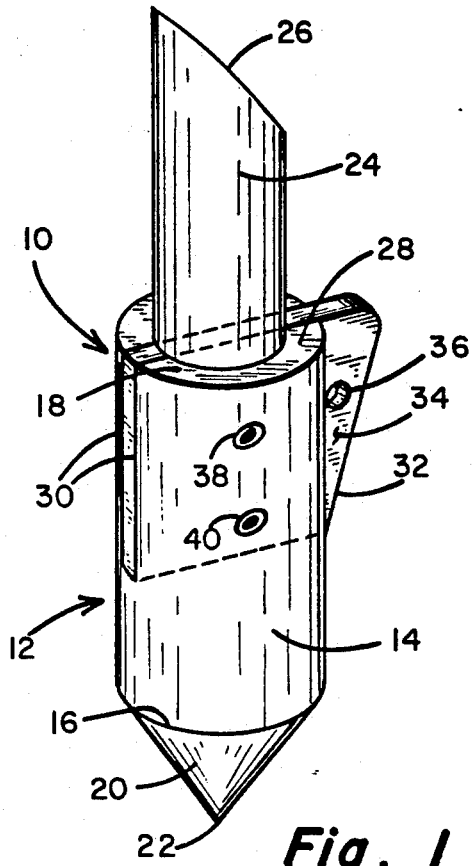
FIG. 1 is a perspective view of the ground anchor device in accordance with the present invention.
Figure 3:
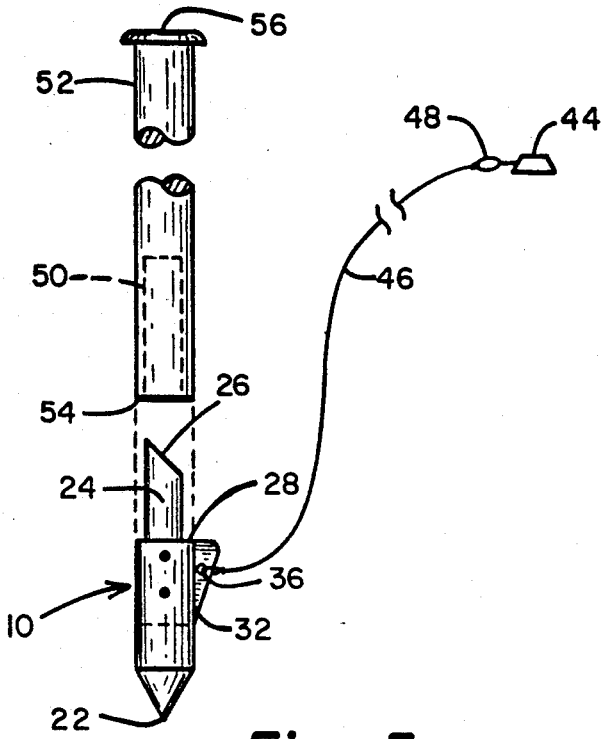
FIG. 3 illustrates the tool used in driving the anchor device into the ground.

Referring to FIG. 1, there is indicated generally by numeral 10 the ground anchor construction in accordance with the present invention. It is seen to include a one-piece, molded body member 12 including a generally cylindrical central body portion 14 having first and second opposed ends 16 and 18. The end 16 of the central body portion forms the base of a cone portion 20 which terminates in a point 22. Projecting longitudinally from the end 18 of the central body portion 14 is an integrally molded, concentrically disposed, cylindrical stem portion 24, the free end 26 of which is beveled at an angle of about 45°. The outside diameter of the stem portion 24 is less than the outside diameter of the central body portion 14, and as such, an annular shoulder 28 is created on the end 18 of the central body portion.

Formed diametrically through the central body portion 14 is a slot 30 into which is fitted a trapezoidally-shaped metal plate member 32 which may be steel or aluminum of a sufficient thickness to avoid its failure when subjected to high tensile forces. It includes an outwardly extending portion 34 which radially projects from the slot and beyond the periphery of the central body portion 14. An aperture 36 is formed through the plate 32 and serves as a tie point eye for a rigid rod, cable, chain or rope. The type of coupling between the anchor and the device being constrained depends upon the particular application to which the anchor is put. Because the eye in the tie plate is laterally displaced from the centerline of the molded plastic body and offset from the center of mass of that molded body, tensioning of a tie member connected to the eye produces a rotation of the anchor about a transverse axis. The tie plate 32 may be held in the slot 30 by means of roll pins 38 and 40 which pass through bores drilled in the cylindrical body portion 14 and through the tie plate 32.

Rather than cutting a slot into which the tie plate may be inserted, it is also possible to place the tie plate into the mold in which the body member 12 is formed such that the tie plate and the molded plastic body are joined in situ. To create a greater resistance against the tie plate pulling free of its plot in the molded body 12, it is preferred that one or more holes be formed through the tie plate so that the molten plastic will flow therethrough prior to solidifying, and thereby creating plate securing "pins" during the molding operation.

Figure 2:
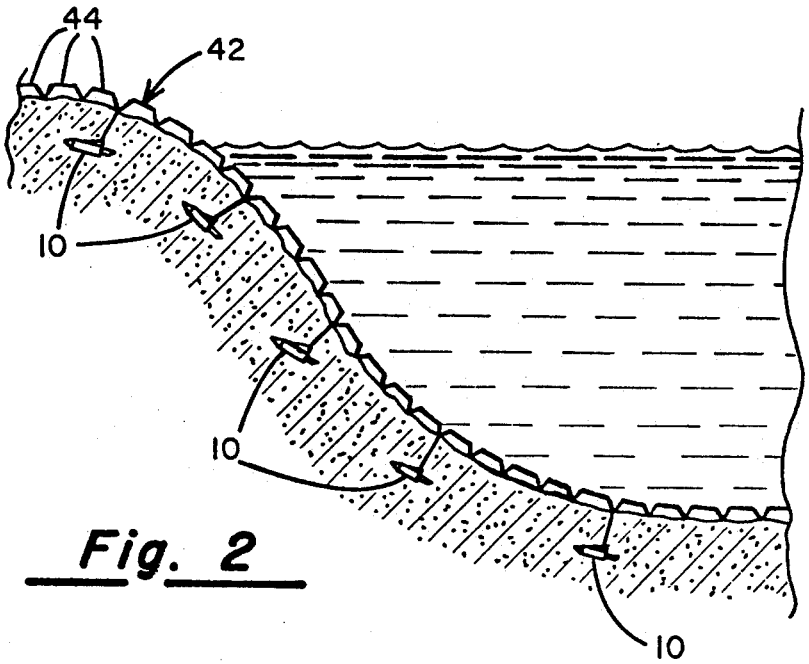
FIG. 2 shows the manner in which a ground anchor of the present invention is used in securing a concrete mat in place.

FIG. 2 is intended to show the manner in which the ground anchor 10 of the present invention may be used to hold a concrete erosion control mat 42 in place in a drainage ditch, creek bed or the like. The concrete mats may be of the type described in the aforereferenced Crow et al. U.S. Pat. No. 4,375,928 and, as such, comprises a plurality of concrete blocks 44 of a predetermined shape, such as truncated pyramids. The blocks are disposed in a grid array of rows and columns. One or more cables extend through the array to maintain the individual blocks in the grid configuration. Concrete mats constructed in accordance with that patent are somewhat flexible and, therefore, can be made to conform to the terrain on which the mats are situated. The anchors 10 of the present invention are used to anchor the mats to the ground to prevent them from shifting under the force of the water stream that may impact them.

To anchor the mats in the manner illustrated in FIG. 2, a cable or chain 46 is secured to the tie point aperture 36 on the plate 32 and the other end of the cable or chain 46 is secured to a loop 48 formed on the cable that threads through the mat blocks 44 using a crosby clamp or other suitable attachment device.

Next, the stem portion 24 of the anchor member 10 is fitted into a cylindrical bore 50 formed in the bottom end 54 of a driving rod 52 such that the bottom end 54 abuts the shoulder 28 on the ground anchor. The pointed end 22 of the molded plastic body 12 is then held against the ground at the desired anchoring point and a maul or sledge hammer may be used to strike the upper end 56 of the driving rod 52, thereby forcing the ground anchor into the ground until the tie member 46 becomes taut. The drive rod 52 is then pulled back out of the hole which is created as the anchor is driven into the ground. Because the top edge of the tie plate 34 is flush with the surface of shoulder 18, it inhibits any tendency of the drive rod to dig into the somewhat more deformable plastic of which the central body member is formed.

Because of the manner in which the ground anchor is constructed, the tension forces created in the tie member 46 when the mat 42 attempts to shift causes the ground anchor to turn in the ground until the anchor body is disposed generally transverse to the tie member 46. This increases the effective surface area of the anchor relative to the ground in the direction that the force is applied, making it more difficult for the anchor to be pulled free of the earth. The beveled surface 26 on the stem portion 24 facilitates the rotation in that the somewhat pointed end thereof tends to dig into the ground to hold that end as the rest of the anchor body tends to rotate from the position in which it resides when first driven into the ground to the rotated position shown in FIG. 2.

While the invention has been described primarily in its application for holding concrete erosion control mats in place, those skilled in the art can appreciate that the ground anchor of the present invention may be used for many different purposes, including tent stakes, guy wire anchors for tall towers or the like, etc.

This invention has been described herein in considerable detail in order to comply with the Patent Statutes and to provide those skilled in the art with the information needed to apply the novel principles and to construct and use such specialized equipment and devices, and that various modifications, both as to the equipment details and operating procedures, can be accomplished without departing from the scope of the invention itself.

What is claimed is:

1. A ground anchor for securing one of a rod cable, chain or rope to the ground comprising:

(a) a molded body having a central cylindrical body portion with first and second opposed ends, one end terminating in a point and the other end having a longitudinally extending, concentrically disposed cylindrical stem of a lesser diameter than that of said central cylindrical body portion to thereby define an annular shoulder on said other end of said central cylindrical body portion, said molded body including a diametrically extending slot formed in said central cylindrical body portion;

(b) a tie plate fitted into said slot and including a portion extending outwardly from said slot, said outwardly extending portion having a tie point adapted to receive said one of said rod, cable, chain or rope therethrough; and (c) means for rigidly securing said tie plate in said slot.

2. The ground anchor as in claim 1 wherein said molded body including said central cylindrical portion and said cylindrical stem are unitary and formed from plastic.

3. The ground anchor as in claim 2 wherein said plastic is a glass filled polyethylene.

4. The ground anchor as in claim 1 wherein said means for securing said tie plate in said slot comprises at least one pin member radially extending through said tie plate.

5. The ground anchor as in claim 2 wherein said means for securing said tie plate in said slot comprises at least one aperture extending through the thickness dimension of said tie plate and which becomes filled with said plastic when said molded body is formed.

6. The ground anchor as in claim 4 wherein said tie plate is metal.

7. The ground anchor as in claim 6 wherein said metal is aluminum or steel.

8. The ground anchor as in claim 1 and further including a ground anchor driving member comprising an elongated steel rod having opposed ends, one end including a tubular socket formed therein for receiving said cylindrical stem therein with said one end of said rod abutting said shoulder, the other end of said rod adopted to be impacted by a driving tool.

9. The ground anchor as in claim 1 wherein the free end of said stem is beveled.

10. The ground anchor as in claim 1 wherein said tie plate is trapezoidal in shape.

11. The ground anchor as in claim 1 wherein said tie point is displaced laterally from the longitudinal centerline and offset from the center of mass of said molded body.

* * * * *